US009058712B2

(12) United States Patent
Magno

(10) Patent No.: US 9,058,712 B2
(45) Date of Patent: Jun. 16, 2015

(54) BEVERAGE VENDING MACHINE CUP DISPENSER ASSEMBLY

(75) Inventor: Alessandro Magno, Brembate Sopra (IT)

(73) Assignee: N&W GLOBAL VENDING S.P.A, Valbrembo (IT)

( * ) Notice: Subject to any disclaimer, the term of this patent is extended or adjusted under 35 U.S.C. 154(b) by 438 days.

(21) Appl. No.: 13/263,145

(22) PCT Filed: Apr. 8, 2010

(86) PCT No.: PCT/IB2010/000780
§ 371 (c)(1),
(2), (4) Date: Feb. 2, 2012

(87) PCT Pub. No.: WO2010/116245
PCT Pub. Date: Oct. 14, 2010

(65) Prior Publication Data

US 2012/0118911 A1 May 17, 2012

(30) Foreign Application Priority Data

Apr. 9, 2009 (IT) ..... TO2009A0277

(51) Int. Cl.

| | |
|---|---|
| ***B65G 59/00*** | (2006.01) |
| ***G07F 13/10*** | (2006.01) |
| ***G07F 11/26*** | (2006.01) |
| ***G07F 11/58*** | (2006.01) |

(52) U.S. Cl.
CPC ..... *G07F 13/10* (2013.01); *G07F 11/26* (2013.01); *G07F 11/58* (2013.01)

(58) Field of Classification Search
USPC ..... 221/10–12, 191, 194, 208, 209, 239, 221/241, 251, 253
See application file for complete search history.

(56) References Cited

U.S. PATENT DOCUMENTS

| | | | | | |
|---|---|---|---|---|---|
| 1,881,894 | A | * | 10/1932 | Olsen | 221/11 |
| 2,370,848 | A | * | 3/1945 | Doggett | 221/11 |
| 2,869,754 | A | * | 1/1959 | Booth et al. | 221/11 |
| 3,053,599 | A | * | 9/1962 | Mortara | 312/43 |
| 3,277,930 | A | * | 10/1966 | Carpigiani | 141/174 |
| 3,311,260 | A | * | 3/1967 | Kinney | 221/11 |
| 3,347,413 | A | * | 10/1967 | Kopera | 221/11 |
| 3,648,889 | A | * | 3/1972 | Greaves et al. | 221/11 |
| 3,771,691 | A | * | 11/1973 | Rockola | 221/11 |
| 4,511,060 | A | * | 4/1985 | Lindsey | 221/115 |
| 4,529,101 | A | * | 7/1985 | Orlowski | 221/11 |
| 6,415,953 | B1 | * | 7/2002 | O'Brien et al. | 221/196 |

FOREIGN PATENT DOCUMENTS

| | | |
|---|---|---|
| FR | 2491888 | 4/1982 |
| JP | 4032993 | 2/1992 |
| WO | WO 2009/138865 | 11/2009 |

OTHER PUBLICATIONS

International Search Report and Written Opinion from International Application No. PCT/IB2010/000780, dated Sep. 6, 2010.

* cited by examiner

*Primary Examiner* — Gene Crawford
*Assistant Examiner* — Kelvin L Randall, Jr.
(74) *Attorney, Agent, or Firm* — Dorsey & Whitney LLP

(57) ABSTRACT

A dispenser assembly for dispensing cups in a beverage vending machine, the assembly having a dispensing device for releasing one cup at a time from a stack of cups; and a belt conveyor, which defines a store for two parallel, staggered lines of stacks, communicates with the dispensing device via an outlet, and is connected to a wall, for pushing the stacks, by a friction coupling, so as to draw the wall, in use, towards the outlet.

10 Claims, 3 Drawing Sheets

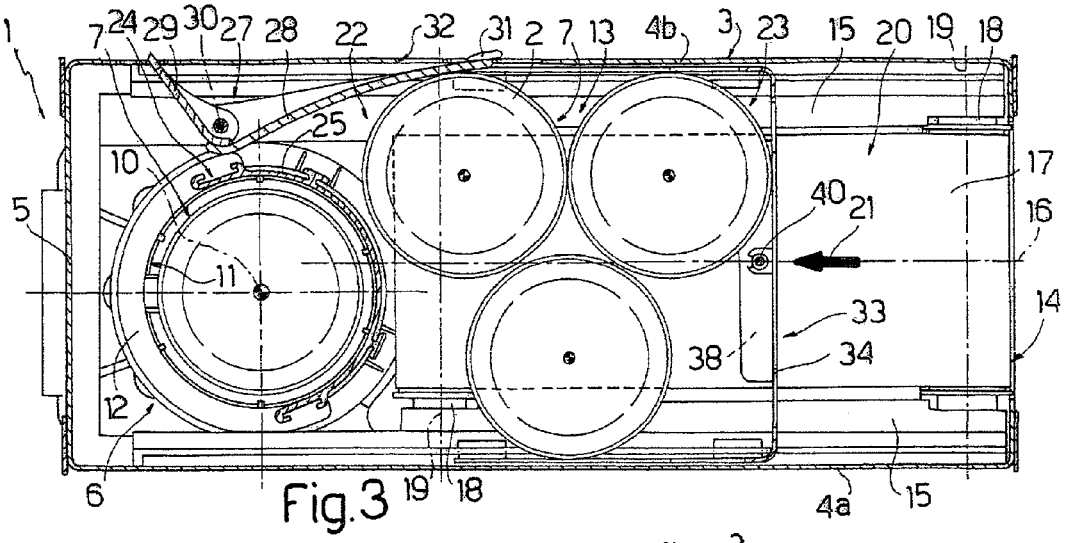
Fig.3
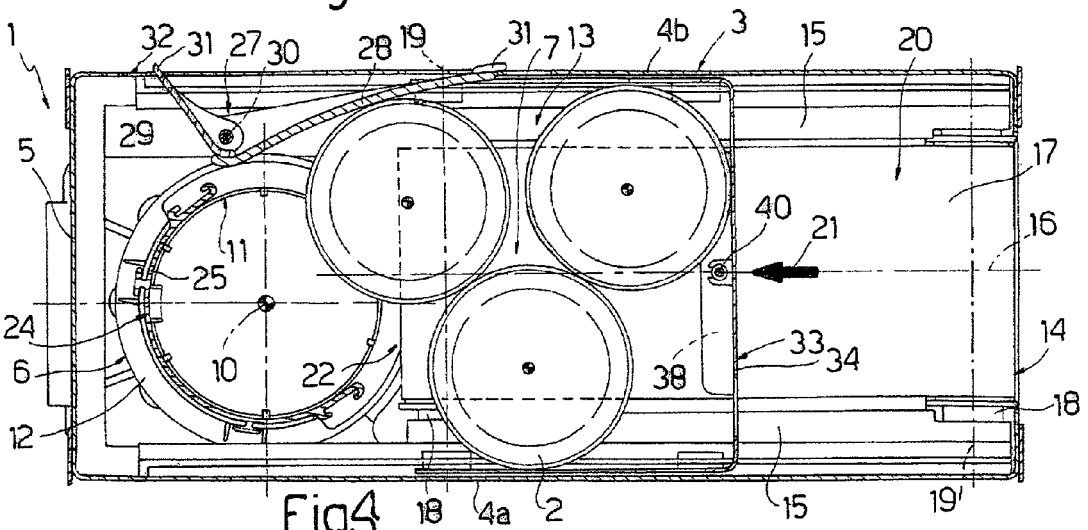
Fig.4
Fig.5
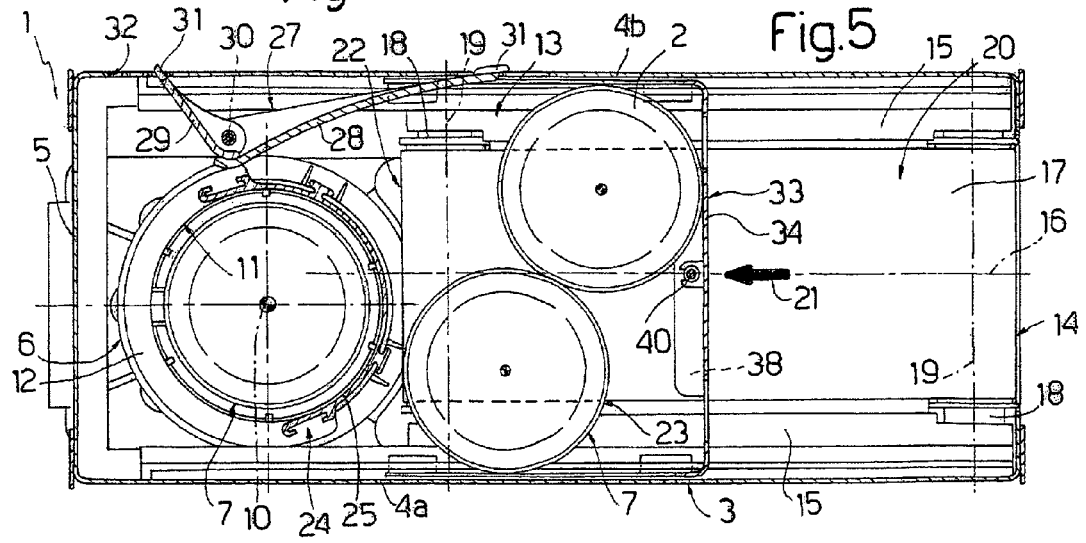

BEVERAGE VENDING MACHINE CUP DISPENSER ASSEMBLY

CROSS-REFERENCE TO RELATED APPLICATIONS

This application is a U.S. Nationalization of PCT International Application No. PCT/IB2010/000780 filed 8 Apr. 2010, entitled "BEVERAGE VENDING MACHINE CUP DISPENSER ASSEMBLY," which claims priority to Italian Patent Application No. TO2009A000277 filed 9 Apr. 2009, the contents of both of the foregoing applications are incorporated herein, in their entirety, by this reference.

TECHNICAL FIELD

Embodiments of the present invention relate to a beverage vending machine cup dispenser assembly.

More specifically, embodiments of the present invention relate to a cup dispenser assembly of the type comprising a dispensing device for receiving a stack of cups and releasing, in use, one cup at a time; and a store for storing stacks of cups and selectively feeding the stacks to the dispensing device when the dispensing device is empty.

BACKGROUND ART

In known vending machines of the above type, the store is normally defined by a revolver device having a number of vertical channels, which house respective stacks of cups and have respective axes equally spaced so as to lie on a cylindrical surface. The revolver device is mounted to rotate about a vertical axis to selectively move each channel into a transfer position, in which the channel releases the respective stack to the dispensing device.

Being hollow in the middle, stores of the above type have the drawback of being extremely bulky in proportion to their storage capacity, so manufacturers are most often forced to achieve a suitable compromise between self-sufficiency and compactness of the machine.

To satisfy these two conflicting requirements, "linear" stores have been proposed, i.e. stores containing a line of stacks aligned in a straight conveying direction.

One example of a "linear" store is described in FR 2491888, in which the store is defined by two lateral walls, and a bottom wall which, together with the lateral walls, defines a space for housing a line of cup stacks and closed at one end by a transfer device for feeding the stacks selectively to the dispensing device.

Another example of a "linear" store is described in JP 4032993, in which the store is structurally similar to the one described in FR 2491888, except that the bottom wall is defined by a belt conveyor. In both cases, the store comprises a stack retaining device for keeping the stacks upright and compact in the conveying direction, and which is defined by a plate held contacting and pressed against the last stack in the line by elastic means.

Assemblies of the above type have the drawback of the retaining plate exerting a constant force on the cup stacks in the conveying direction. As a result, when the stacks are not moving towards the transfer device, they are pressed against the transfer device, the effects of which get worse as the stacks are unloaded, even to the point of possibly damaging or crushing the cups.

SUMMARY

One or more embodiments of the present invention provide a cup dispenser assembly of the above type, which is cheap and easy to produce and designed to eliminate the above drawback.

According to an embodiment of the present invention, there is provided a beverage vending machine cup dispenser assembly The dispenser assembly includes a dispensing device for receiving a stack of cups and, in use, releasing one cup at a time. The dispenser assembly further includes a store for storing stacks of cups and feeding the stacks selectively to the dispensing device when the dispensing device is empty. The store includes belt conveyor means that comprise a belt for supporting the stacks and movable in a given conveying direction. The store further includes an outlet communicating with the dispensing device and retaining means for retaining the stacks in the conveying direction. The retaining means include a wall positioned, in use, against the last of the stacks on the belt. The wall is connected to the belt by a friction coupling, so as to be drawn along, in use, by the belt in the conveying direction, together with the stacks, to keep the stacks compacted in an upright position.

BRIEF DESCRIPTION OF THE DRAWINGS

A non-limiting embodiment of the present invention will be described by way of example with reference to the accompanying drawings, in which:

FIGS. 3 to 5 show sections, along line in FIG. 1, of the FIG. 1 assembly in respective operating configurations;

BEST MODE FOR CARRYING OUT THE INVENTION

Figure 1:
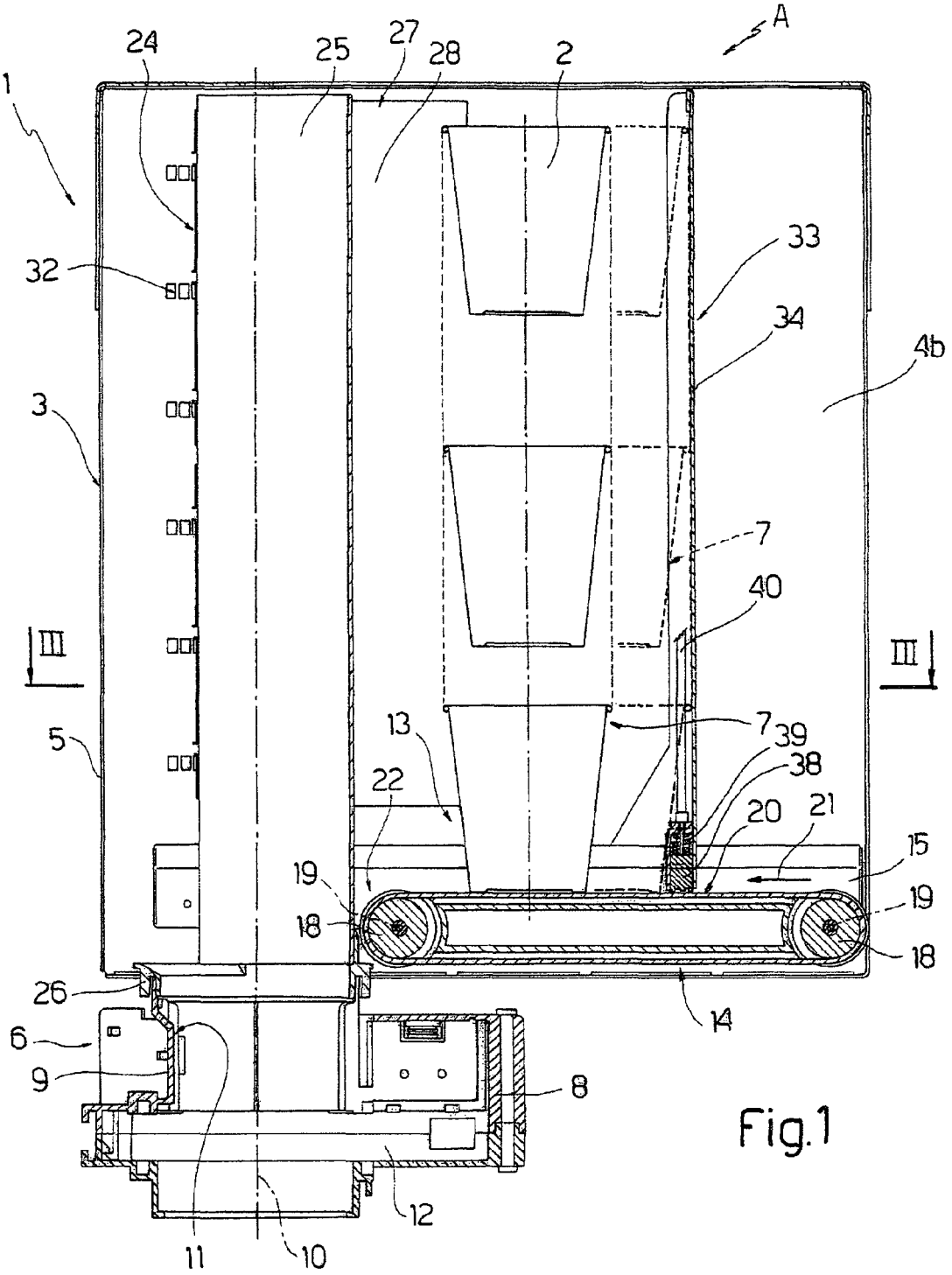
FIG. 1 shows an axial section of a preferred embodiment of the cup dispenser assembly according to the present invention.

Number 1 in FIG. 1 indicates as a whole a dispenser assembly of a beverage vending machine A, for dispensing cups 2.

The cups 2 employed in assembly 1 are known types commonly used in beverage vending machines. In the example shown, each cup 2 is defined by a cup-shaped body made of plastic or paper material and having a truncated-cone-shaped lateral wall, which has an outer annular flange of given diameter at its wide end, and is closed at its narrow end by a flat bottom wall.

In a normal beverage-making cycle, the function of assembly 1 is to feed an empty cup 2 to a pickup device (not shown) normally located beneath assembly 1 and movable between assembly 1 and a filling station where the empty cup 2 is filled either with the beverage or the beverage ingredients.

As shown in FIGS. 1 and 3, assembly 1 comprises a box casing 3 defined by two vertical parallel lateral walls 4*a* and 4*b*, and by a transverse wall 5 perpendicular to and connecting respective ends of lateral walls 4*a*, 4*b*.

Assembly 1 comprises a known dispensing device 6 fitted to casing 3 and designed to house a stack 7 of cups 2 and dispense, on command, one cup 2 at a time from the bottom of stack 7. Accordingly, dispensing device 6 comprises an outer body 8 located beneath casing 3, close to transverse wall 5, and fitted inside with a tube 9, which is coaxial with a vertical axis 10, is offset towards lateral wall 4*a* with respect to the centerline between lateral walls 4*a* and 4*b*, and defines a hole 11 larger in diameter than the outer annular flange of each cup 2.

Dispensing device 6 comprises a release device 12 located along tube 9, inside body 8, and having a number of cams (not shown) arranged about the periphery of hole 11, so as to support a stack 7 inside an inlet portion of hole 11 and, when activated, withdraw a cup 2 from the bottom of stack 7 and allow cup 2 to drop to the pickup device (not shown).

Inside the space defined by box casing 3, assembly 1 comprises a store 13 for housing a number of stacks 7 and feeding one stack 7 at a time to dispensing device 6 when this is empty.

Figure 2:
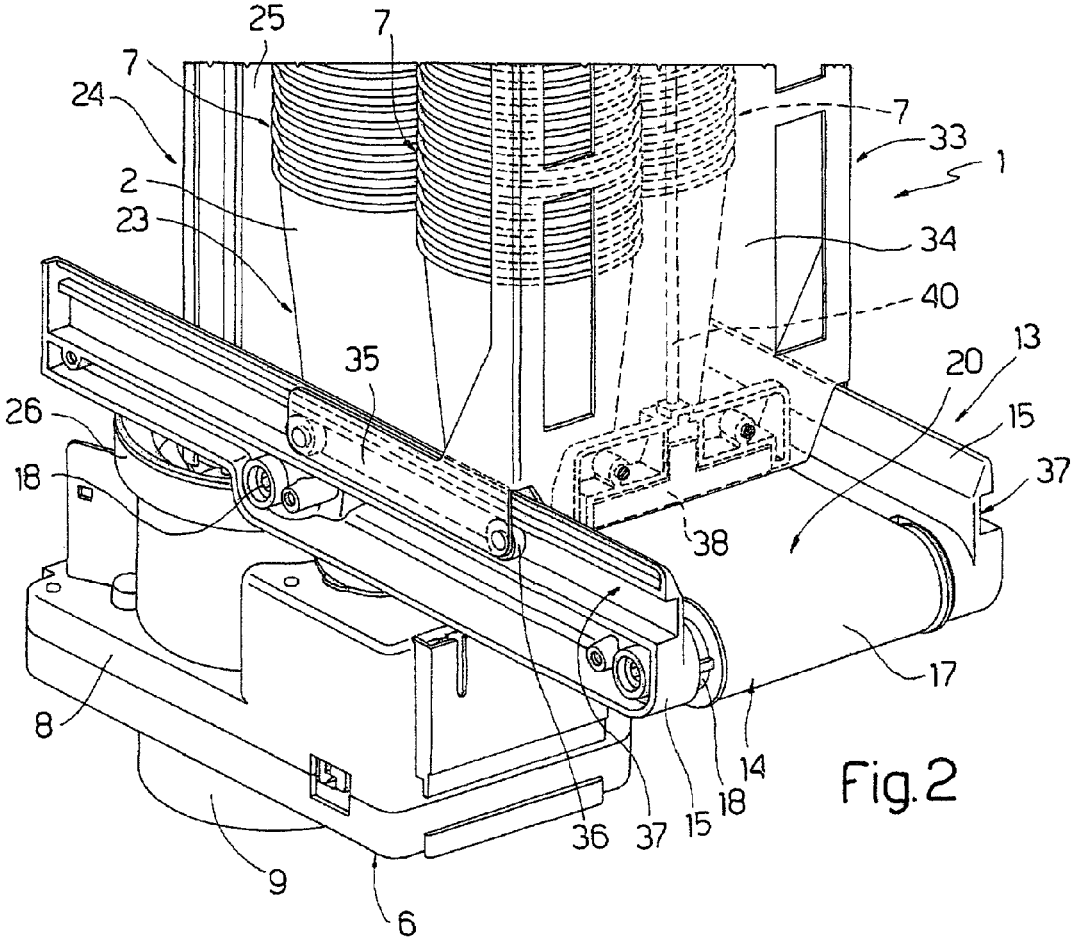
FIG. 2 shows a three-quarter rear view in perspective, with parts removed for clarity, of the FIG. 1 assembly.

More specifically, and with reference to FIGS. 1, 2 and 3, store 13 comprises a belt conveyor 14 in turn comprising a frame defined by two parallel plates 15, which are located on opposite sides of a horizontal axis of symmetry 16 crosswise to axis 10, and are each connected rigidly to a bottom-edge portion of a respective lateral wall 4*a*, 4*b*.

Belt conveyor 14 comprises a belt 17 looped about two pulleys 18, one of which is a drive pulley, and which are fitted between plates 15 to rotate about respective axes 19 crosswise to axis 16. One of pulleys 18 is located at the respective free axial ends of plates 15, while the other is hinged to intermediate portions of plates 15, close to the inlet of tube 9, to define, on belt 17 and together with the other pulley 18, a horizontal work branch 20, which runs in a conveying direction 21 parallel to axis 16, and has an outlet 22 directly over and tangent to the inlet of tube 9.

As shown in FIGS. 2 and 3, belt 17, measured crosswise to axis 16, is slightly narrower than the distance between plates 15, so that branch 20 defines a supporting surface for two parallel, side by side lines 23 of stacks 7 staggered in conveying direction 21. In the FIG. 3 configuration, for example, the two lines 23 contain one and two stacks 7 respectively.

A valve device 24 forming part of assembly 1 is located between belt conveyor 14 and dispensing device 6, and is activated, in use, to open and close communication between outlet 22 and hole 11 and so enable and disable transfer of a stack 7 from belt conveyor 14 to dispensing device 6.

As shown in FIGS. 1 and 3, valve device 24 comprises a semitubular member 25 which is coaxial with axis 10, extends roughly the full height of lateral walls 4*a*, 4*b*, is roughly the same diameter as hole 11, and is connected rigidly at its bottom end to a powered coupling 26. Coupling 26 is fitted in rotary manner to a top free edge of tube 9, and is activated, as described below, to rotate about axis 10 and move semitubular member 25 to and from a closed position (FIGS. 3 and 5)—in which semitubular member 25 is positioned with its convex side facing belt conveyor 14 and separates outlet 22 from hole 11—via an open position (FIG. 4), in which semitubular member 25 is positioned with its convex side facing transverse wall 5, and connects outlet 22 to hole 11.

Figure 6:
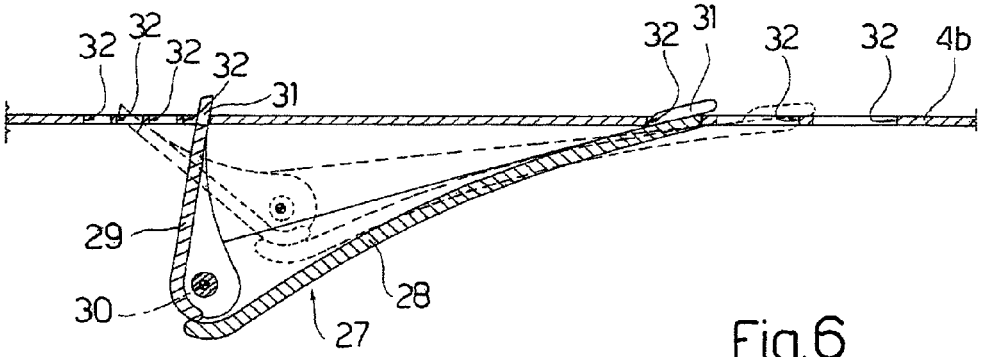
FIG. 6 shows a larger-scale detail of FIGS. 3 to 5.

As shown in FIGS. 1, 3 and 6, assembly 1 also comprises a guide member 27 located in the space between lateral wall 4*b* and semitubular member 25, top guide lines 23 of stacks to hole 11.

With particular reference to FIG. 6, guide member 27 is defined by a V-shaped plate fitted to lateral wall 4*b*, with its concavity facing lateral wall 4*b*, and comprising two wings 28, 29 hinged to each other about an axis 30 parallel to axis 10; and wing 28 extends from semitubular member 25 to lateral wall 4*b* across outlet 22, so as to divert, in use, the stacks 7 in line 23 adjacent to lateral wall 4*b* towards hole 11.

Guide member 27 is only provided on one side of hole 11 because, dispensing device 6 and hole 11 being offset towards lateral wall 4*a*, stacks 7 in the line adjacent to lateral wall 4*a* are substantially aligned with hole 11 and so need no diverting.

In a variation not shown, dispensing device 6 is located centrally with respect to lateral walls 4*a* and 4*b*, so hole 11 is equidistant from both, neither of lines 23 is aligned with hole 11, and guide member 27 therefore comprises two V-shaped plates similar to the one described above, and each fitted to a respective lateral wall 4*a*, 4*b* to selectively divert respective line 23 to hole 11.

Guide member 27 is fitted adjustably to lateral wall 4*b* to adjust the angle of wing 28 with respect to lateral wall 4*b*, and therefore the size of the passage at outlet 22, to the size of cups 2, so that wing 28 is set to a smaller angle for relatively large-diameter cups 2, and to a larger angle for relatively small-diameter cups 2.

Accordingly, as shown in FIGS. 1 and 6, the free edge, parallel to axis 30, of each wing 28, 29 has a number of transverse appendixes 31 equally spaced along the free edge, and each of which engages a respective cavity 32 formed in lateral wall 4*b* and chosen from a respective group of horizontally aligned cavities 32 (only the groups of cavities 32 engaged by appendixes 31 of wing 29 are shown in FIG. 1). As shown in FIG. 6, adjusting the position of appendixes 31 of wings 28, 29 inside respective cavities 32 changes the angle formed between wings 28 and 29 and hence the slope of wing 28.

Assembly 1 also comprises a retaining device 33 for retaining stacks 7 in conveying direction 21. Device 33 comprises a substantially rectangular wall 34 which extends from lateral wall 4*a* to lateral wall 4*b*, perpendicularly to axis 16, rests against the last of stacks 7 resting on branch 20, and is mounted to slide along plates 15, so as to move together with stacks 7 in conveying direction 21 and keep stacks 7 compacted and in the correct upright position.

More specifically, as shown in the drawings, wall 34 is fitted to plates 15 by means of a carriage comprising two brackets 35, each of which is connected rigidly to a respective lateral edge of wall 34, extends parallel to axis 16, in the gap between relative plate 15 and relative lateral wall 4*a*, 4*b*, and is fitted with two rollers 36 which rotate about respective axes crosswise to axis 16, and engage in transversely rolling manner a relative groove 37 parallel to direction 21 and formed on the side of plate 15 facing relative lateral wall 4*a*, 4*b*.

In actual use, wall 34 is moved in direction 21 by belt 17 by means of a friction coupling comprising a skid 38, which is made of material with a high degree of sliding friction, is connected to the bottom edge of wall 34, and is pressed against belt 17 to transmit the movement of branch 20 in direction 21 to wall 34.

As shown in FIG. 1, skid 38, measured crosswise to axis 16, is substantially the same width as belt 17, and is housed inside a seat, which defines part of the bottom edge of wall 34, with the interposition of a spring 39 compressed between skid 38 and a top surface of the seat to push skid 38 onto belt 17.

Skid 38 is fitted with a tie 40, which extends vertically from skid 38 to the free top edge of wall 34, and can be activated by an operator to lift skid 38 off belt 17, in opposition to spring 39, and release the friction coupling, e.g. when loading stacks 7.

Operation of assembly 1 will now be described as of FIG. 3, in which a stack 7 is inserted inside hole 11, semitubular member 25 is in the closed position, and belt conveyor 14 is stationary.

When the stack 7 inside dispensing device 6 runs out, a sensor (not shown) detects the absence of cups 2 and sends a corresponding signal to a central control unit (not shown), which commands start-up of the motor (not shown) of belt conveyor 14, to start belt 17 moving in direction 21.

Shortly after, the motor (not shown) of coupling 26 is activated to rotate coupling 26 and semitubular member 25 360° anticlockwise about axis 10. In a variation not shown, rotation may be clockwise.

As it rotates, semitubular member 25 moves through its open position (FIG. 4), thus allowing the first stack 7 to be pushed by belt 17 through outlet 22 into hole 11. Upon stack 7 dropping into hole 11, said sensor (not shown) detects the presence of cups 2 and sends a corresponding signal to the central control unit (not shown), which commands stoppage of belt conveyor 14. As soon as semitubular member 25 completes a full turn about axis 10 back to the closed position (FIG. 5), the relative motor is also stopped.

In a variation not shown, at this point, conveyor 14 may be operated again in the opposite direction to before, to move branch 20 slightly in the opposite direction to direction 21 and so detach the first stack 7 from semitubular member 25.

In connection with the above, it should be pointed out that, in the interval between activating belt conveyor 14 and activating semitubular member 25, the first stack 7 rests against semitubular member 25, and belt 17 starts running under stacks 7.

The friction coupling between skid 38 and belt 17, however, prevents wall 34 from pressing stacks 7 against one another and against semitubular member 25, and so possibly damaging cups 2. That is, when the resistance of stacks 7 to wall 34 overcomes the friction between skid 38 and belt 17, the friction coupling is released, so that belt 17 no longer moves skid 38 forward, and from that point on runs beneath skid 38, so that wall 34 retains stacks 7 with substantially no thrust.

The invention claimed is:

1. A dispenser assembly for dispensing cups in a beverage vending machine, the dispenser assembly comprising:

a dispensing device for receiving a stack of cups and, in use, releasing one cup at a time; and a store for storing stacks of cups and feeding the stacks selectively to the dispensing device when the dispensing device is empty; the store comprising:

a belt conveyor means comprising a belt for supporting the stacks and movable in a given conveying direction;

an outlet communicating with the dispensing device; and a retaining means for retaining the stacks in the conveying direction; the retaining means comprising a wall positioned, in use, against the last of the stacks on the belt; wherein the wall is connected to the belt by a friction coupling, so as to be drawn along, in use, by the belt in the conveying direction, together with the stacks, to keep the stacks compacted in an upright position;

wherein the wall is fitted, on a side thereof facing the belt, with a skid, the skid being made of material with a high degree of sliding friction, the skid connected to a bottom edge of the wall with the interposition of an elastic means for keeping the skid pressed against the belt.

2. The dispenser assembly as claimed in claim 1, wherein the belt conveyor means comprises a frame defined by two plates substantially parallel to each other and to the conveying direction, and located on opposite sides of the belt; support and guide means, for supporting and guiding the wall, being interposed between the wall and the plates to keep the wall substantially vertical and allow the wall to slide freely with respect to the plates in the conveying direction.

3. The dispenser assembly as claimed in claim 2, wherein said support and guide means comprises two grooves, each formed in a respective plate and substantially parallel to the conveying direction; and a carriage integral with the wall and comprising two brackets, each of which is connected rigidly to a respective lateral edge of the wall, and is fitted with rollers engaging a relative groove in a substantially transversely rolling manner.

4. The dispenser assembly as claimed in claim 1, further comprising valve means interposed between the belt conveyor means and said outlet to control the outlet and permit selective feed of the stacks to the dispensing device.

5. The dispenser assembly as claimed in claim 4, wherein the valve means comprises a semitubular member mounted to rotate about a substantially vertical axis to and from a closed position, in which the semitubular member cuts off communication between the outlet and the dispensing device, and via an open position, in which the semitubular member allows a stack from the belt conveyor means through the outlet to the dispensing device.

6. The dispenser assembly as claimed in claim 5, wherein the semitubular member is powered, and is activated, in use, to make a full turn about said axis when loading each stack into the dispensing device.

7. The dispenser assembly as claimed in claim 4, further comprising guide means located between the valve means and the outlet to direct lines of stacks to the valve means.

8. The dispenser assembly as claimed in claim 7, wherein the guide means is adjustable to adjust the size of the outlet to the size of the cups.

9. The dispenser assembly as claimed in claim 8, wherein the guide means comprises a wall extending at a given angle to connect the valve means and the outlet; the guide means being adjustable by adjusting said angle.

10. The dispenser assembly as claimed in claim 1, wherein the belt conveyor means are designed to house a number of stacks arranged in parallel, staggered lines.

* * * * *